US007472483B2

(12) United States Patent
Beugels

(10) Patent No.: US 7,472,483 B2
(45) Date of Patent: Jan. 6, 2009

(54) SHAVING APPARATUS WITH SPRING-MOUNTED SHAVING HEAD HOLDER

(75) Inventor: Johannes Beugels, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/513,277

(22) PCT Filed: Apr. 23, 2003

(86) PCT No.: PCT/IB03/01689

§ 371 (c)(1),
(2), (4) Date: Nov. 2, 2004

(87) PCT Pub. No.: WO03/095158

PCT Pub. Date: Nov. 20, 2003

(65) Prior Publication Data

US 2005/0172491 A1 Aug. 11, 2005

(30) Foreign Application Priority Data

May 7, 2002 (EP) ..... 02076825

(51) Int. Cl.
*B26B 19/14* (2006.01)

(52) U.S. Cl. ..... 30/43.4; 30/43.5; 30/43.6

(58) Field of Classification Search ..... 30/43.5, 30/43.6, 43.4, 43.7–43.92, 42, 44–47
See application file for complete search history.

(56) References Cited

U.S. PATENT DOCUMENTS

| | | | | | |
|---|---|---|---|---|---|
| 2,787,053 | A * | 4/1957 | Kleinman | 30/43.92 |
| 2,935,788 | A * | 5/1960 | Kleinmann | 30/43.2 |
| 3,001,281 | A * | 9/1961 | Nahon | 30/43.6 |
| 3,196,539 | A * | 7/1965 | Jepson et al. | 30/43.9 |
| 3,590,482 | A * | 7/1971 | Carr | 30/43.9 |
| 3,824,687 | A * | 7/1974 | Baumann | 30/43.92 |
| 3,855,697 | A * | 12/1974 | Meyer et al. | 30/43.92 |
| 3,913,225 | A | 10/1975 | Tietjens et al. | 30/43.6 |
| 3,997,969 | A * | 12/1976 | Czerner et al. | 30/43.92 |
| 4,318,223 | A | 3/1982 | Bergsma et al. | 30/43.6 |
| 4,442,597 | A * | 4/1984 | Bergsma et al. | 30/43.6 |
| 4,688,329 | A | 8/1987 | Oord | 30/43.6 |
| 5,007,168 | A | 4/1991 | Messinger et al. | 30/43 |
| 5,408,749 | A * | 4/1995 | Momose | 30/43.6 |
| 5,625,950 | A | 5/1997 | Sterk et al. | 30/43.6 |
| 5,983,502 | A * | 11/1999 | Geertsma et al. | 30/43.6 |
| 6,354,005 | B1 * | 3/2002 | Bosch | 30/43.6 |
| 6,502,309 | B2 * | 1/2003 | De Vries et al. | 30/34.2 |
| 6,568,083 | B1 * | 5/2003 | Taniguchi et al. | 30/43.2 |
| 2006/0179657 | A1 * | 8/2006 | Van Derr Linden et al. | 30/43.6 |
| 2008/0092393 | A1 * | 4/2008 | Van Der Meer | 30/43.6 |

* cited by examiner

*Primary Examiner*—Jason Daniel Prone

(57) ABSTRACT

Shaving apparatus having a housing (1) and a shaving head holder (2) that is pivotably connected to the housing (1) and can pivot from an open position to a closed position against the force of a spring (8), and having latching means (10-13) for latching the shaving head holder to, and unlatching the shaving head holder from, the housing in a closed position of said holder. To improve the skin contour-following properties during shaving, the shaving head holder (2) in its closed position can be depressed against the force of a spring (8).

10 Claims, 3 Drawing Sheets

SHAVING APPARATUS WITH SPRING-MOUNTED SHAVING HEAD HOLDER

FIELD OF THE INVENTION

The invention relates to a shaving apparatus comprising a housing and a shaving head holder provided with at least one cutting unit comprising an external cutting member with hair-entry apertures and an internal cutting member which can be rotated with respect to the external cutting member, which shaving head holder is connected to the housing so as to be pivotable about a pivot pin, and can be pivoted from a first position, wherein the shaving head holder is in an open position with respect to the housing, against the action of a spring, to a second position wherein the shaving head holder is in a closed position with respect to the housing, and latching means are present to latch the shaving head holder in the second position on the housing or to unlatch it from the housing.

BACKGROUND OF THE INVENTION

Such a shaving apparatus is known from U.S. Pat. No. 4,318,223. It is known that in order to make shaving easier the shaving head holder and/or the cutting units, also referred to as shaving heads, can be embodied so as to be slightly floating and/or tiltable with respect to the housing of the shaving apparatus which also forms the handle. By virtue thereof, the shaving surface that is formed by the outside surface of the external cutting members can follow the contours of the facial surface more readily. As a result, to shave facial surfaces that are more difficult to reach, such as under the skin, the user does not have to make many additional movements of the wrist to reach the facial surfaces with the shaving head(s). Such shaving apparatus thus follow the contours of the face. Shaving apparatus with a tiltable shaving head holder are known, for example, from U.S. Pat. No. 4,688,329 and U.S. Pat. No. 5,007,168, and shaving apparatus with tiltable cutting units are known, for example, from U.S. Pat. Nos. 3,913,225 and No. 5,625,050.

It is an object of the invention to render the shaving head holder of the shaving apparatus mentioned in the opening paragraph depressible against the action of a spring in the operating condition, using simple means.

SUMMARY

To achieve this, the shaving apparatus in accordance with the invention is characterized in that the shaving head holder in the second position can be depressed over a small distance against the action of the spring.

In this second position, wherein the shaving head holder is in a closed position with respect to the housing, which is the normal operating position for shaving, the shaving head holder can be depressed against the action of a spring when the shaving head holder is pressed against the skin. This causes the shaving head holder to pivot about its pivot pin.

Such a shaving head holder that can he depressed against the action of a spring can be realized in an embodiment which is characterized in that the latching means comprise a latching cam situated in the housing, which latching cam can be displaced against the action of a spring from a latched position to an unlatched position of the shaving head holder and, in the second position of the shaving head holder, the latching cam hooks behind a wall portion of the shaving head holder to latch the shaving head holder onto the housing, an edge portion of the shaving head holder being situated at some distance from an opposite edge portion of the housing, the shaving head holder being pivotably depressible over the distance. In the latched state, the shaving head holder is thus locked against rotation to the open position. Preferably, the latching means are situated at the edge of the housing opposite the pivot pin.

A further embodiment of the shaving apparatus in accordance with the invention is characterized in that the housing is provided with an upright wall portion the height of which is greater than the distance over which the shaving head holder can be depressed. As a result of this measure, in the second, closed position of the shaving head holder there is no gap between opposite edge portions of the shaving head holder and the housing. It is thus ensured that cut-off hair parts remain inside the hair chamber.

BRIEF DESCRIPTION OF THE DRAWINGS

These and other aspects of the invention are apparent from and will be elucidated with reference to the embodiment(s) described hereinafter.

In the drawings.

DETAILED DESCRIPTION

Figure 1:
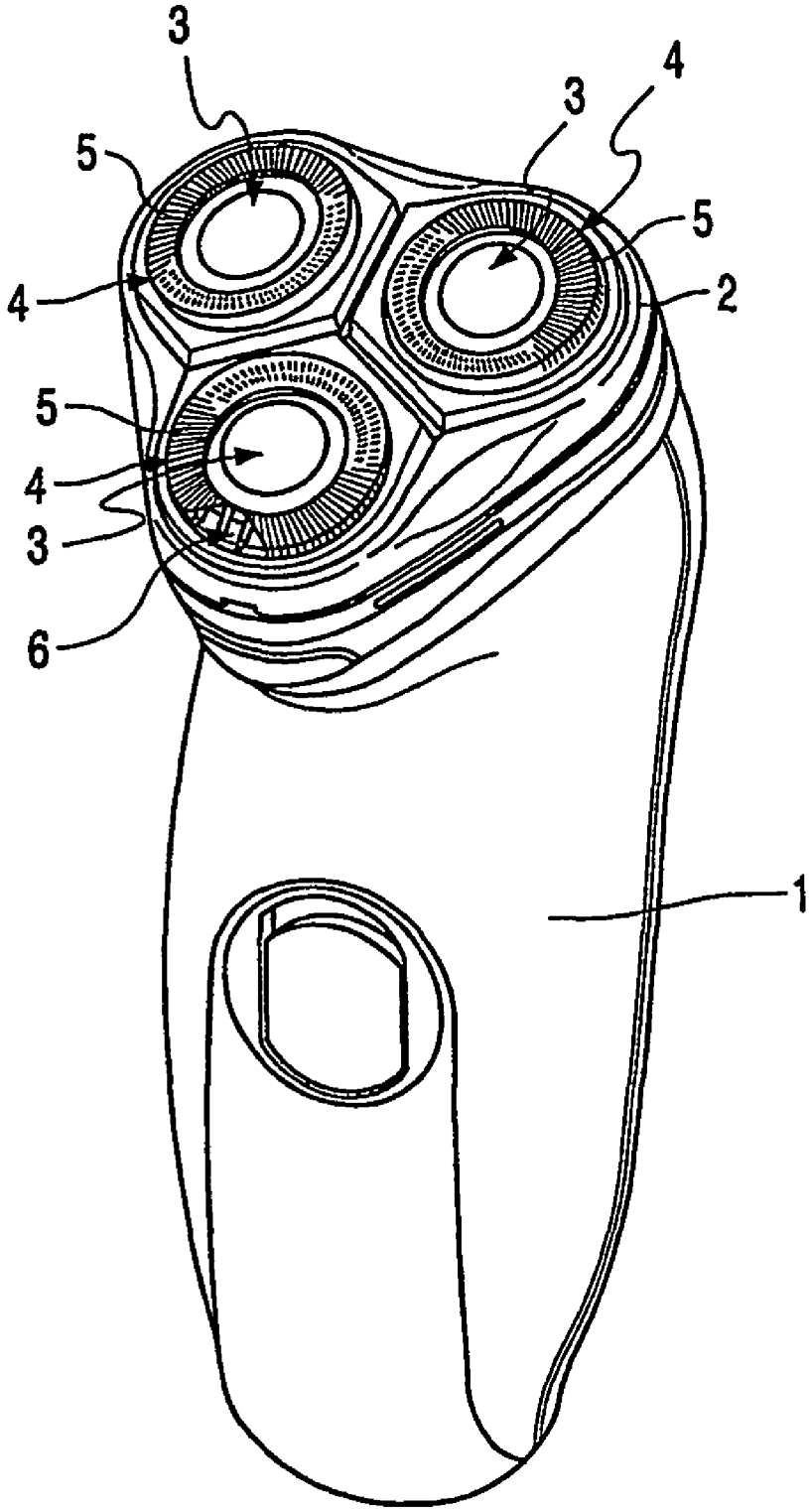
FIG. 1 is a perspective view of a shaving apparatus with a shaving head holder comprising three cutting units.

FIG. 1 shows a rotary shaving apparatus comprising a housing 1 and a shaving head holder 2 that is pivotably connected to the housing. The shaving head holder accommodates three cutting units 3, also referred to as shaving heads, which each comprise an external cutting member 4 having hair-entry apertures 5 and an internal hair cutting member 6 which is rotatably drivable with respect to the external cutting member 4. The internal cutting members are driven in known manner by a motor (not shown) in the housing of the shaving apparatus.

Figure 2A:
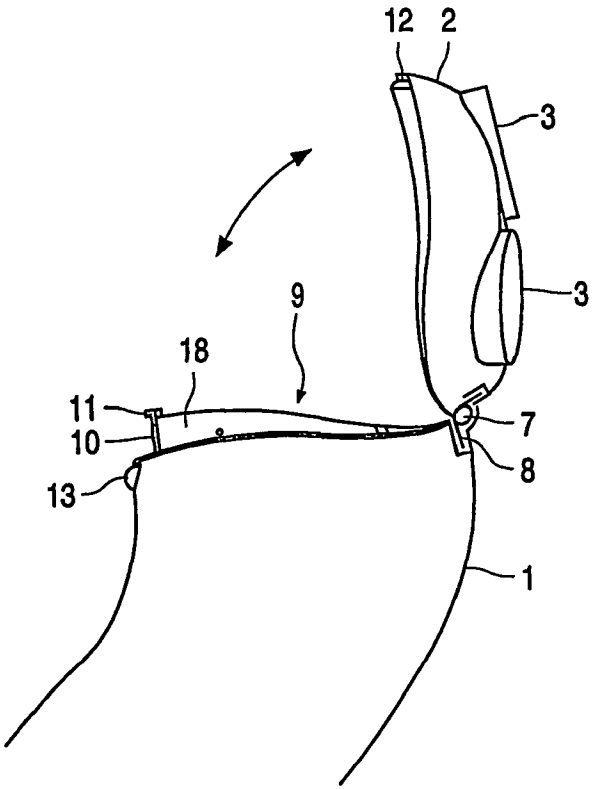
FIG. 2*a* shows the shaving apparatus of FIG. 1, the shaving head holder being in an open position with respect to the housing of the shaving apparatus.

In FIG. 2*a*, the shaving head holder 2 is shown in a first position wherein the holder is in an open position with respect to the housing 1. The shaving head holder 2 is connected to the housing 1 by means of a spring pivot. The spring pivot has a pivot pin 7 with a coil spring 8, the end portions of which are clamped in the shaving head holder and in the housing. The spring force is such that the coil spring keeps the shaving head holder in the open position. In the open position, the hair chamber 9 situated between the shaving head holder 2 and the housing 1, and the cutting units can be cleaned.

Figure 2B:
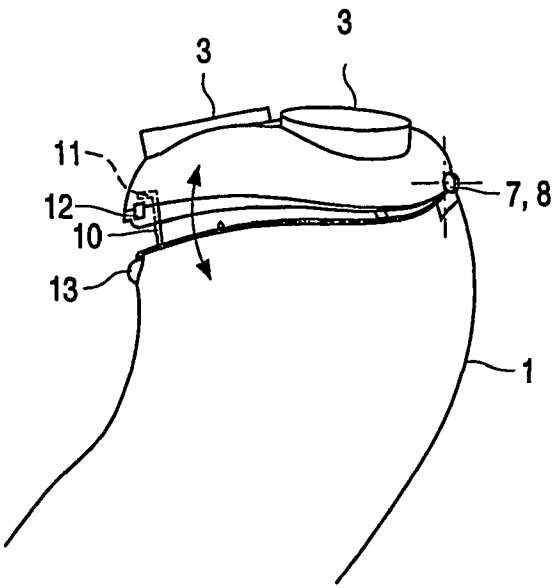
FIG. 2*b* shows the shaving apparatus of FIG. 1, the shaving head holder being latched onto the housing in an undepressed position.
Figure 2C:
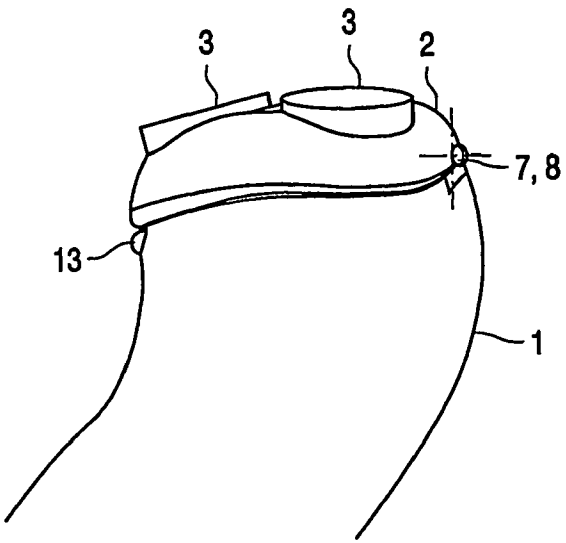
FIG. 2*c* shows the shaving apparatus of FIG. 2*b*, the shaving head holder being completely depressed.
Figure 3:
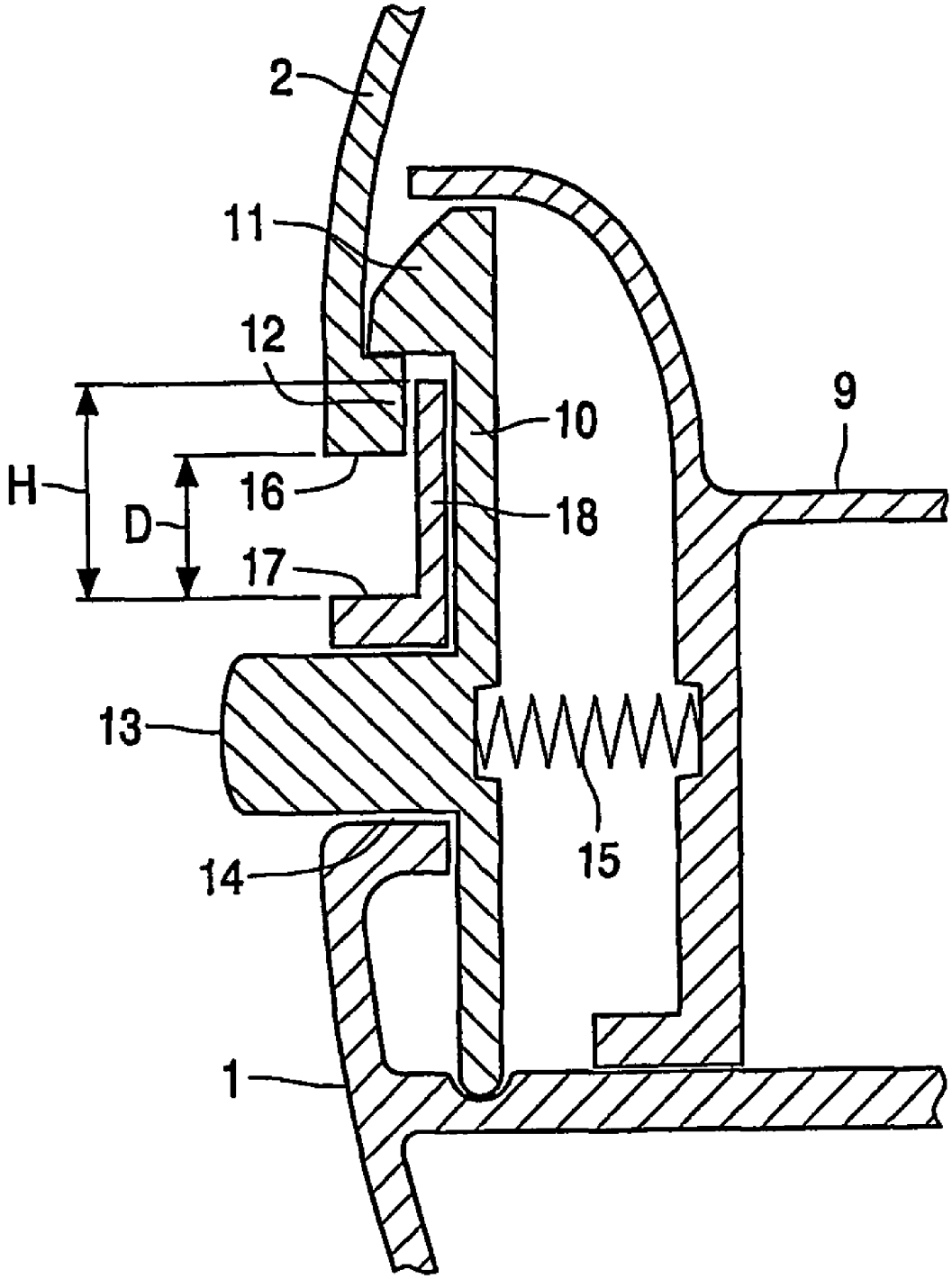
FIG. 3 is a cross-sectional view of the latching means for the shaving head holder.

In FIG. 2*b*, the shaving head holder 2 is shown in a second position wherein the holder is in a closed position with respect to the housing 1. The closed position is obtained by pivoting the shaving head holder from the open position against the action of the coil spring 8. In the closed position, the shaving head holder is latched to the housing 1 by means of latching means. The latching means are shown in FIG. 3 and include a latching arm 10 accommodated in the housing 1 and provided with a depressible, hook-shaped latching cam 11 and a wall portion 12 of the shaving head holder 2 co-operating therewith. The latching cam 11 is situated at one end of the arm 10, and the other end of the arm is pivotably accommodated in the housing. Between the ends of the arm there is an operating knob 13 that projects through an opening 14 of the housing 1. By means of the operating knob 13, the latching cam 11 can be displaced, against the action of the spring pressure exerted by a spring 15, from a latched position to an unlatched position of the shaving head holder 2. In the latched position, the latching cam 11 hooks behind the wall portion 12 of the shaving head holder, causing the latter to be latched to the housing 1 against the action of the coil spring 8, that is to say that the shaving head holder is prevented from pivoting to the open position. As shown in FIG. 3, an edge portion 16 of the shaving head holder 1 is at a distance D from an edge portion 17 of the housing 1. This is the distance over which the shaving head holder can be pivotably depressed relative to the housing against the action of the spring 8. In FIG. 2*c* the situation is shown wherein the shaving head holder is fully depressed and the edge portions 16 and 17 come into contact with each other. The housing 1 is further provided with an upright wall portion 18 (also see FIGS. 2*a* and 2*b*). The height H of this wall portion is greater than the distance D between the edge portions 16 and 17. The upright wall portion precludes that, in the closed operating position of the shaving head holder, cut-off hair parts can escape to the exterior by passing between the edge portions 16 and 17.

It will be clear that other latching means are also possible provided that, on the one hand, they preclude that in the second position, wherein the shaving head holder is in a closed position with respect to the housing and which is the normal operating position for shaving, the shaving head holder can pivot to the open, first position, and, on the other hand, that they enable the shaving head holder to be depressible against the action of a spring. It is for example possible to provide the operating knob 13 as a separate knob in a wall opening of the shaving head holder opposite the latching cam 11. By depressing such a knob, the latching cam 11 is pressed back and the shaving head holder is unlatched.

The invention claimed is:

1. A shaving apparatus comprising:

a housing:

a shaving head holder including at least one cutting, unit comprising an external cutting member with hair-entry apertures and an internal cutting member which can be rotated with respect to the external cutting member;

a pivot pin for pivotably connecting the shaving head holder to the housing, the shaving head holder being pivotably movable in a first direction to a first position and in a second direction to a second position, the shaving head holder in the first position being in an open position with respect to the housing and the shaving head holder in the second position being in a closed position with respect to the housing:

a first spring for applying a spring force to maintain the shaving head holder in the first position; and a latch on the housing having a latched position for latching the shaving head holder in the second position and preventing the shaving head holder from moving in the first direction toward the first position or for unlatching the shaving head holder from the housing, the shaving head holder in the second position being pivotably depressible over a distance associated with the latch and against the spring force applied by the first spring.

2. A shaving apparatus as claimed in claim 1, wherein the latch comprises a latching, cam situated in the housing, wherein the latching cam can be displaced against the action of a second spring from a latched position to an unlatched position of the shaving head holder and, in the second position of the shaving head holder, said latching cam hooks behind a wall portion of the shaving head holder to latch the shaving head holder on the housing, an edge portion of the shaving head holder being situated at the distance from an opposite edge portion of the housing, said shaving head holder being pivotably depressible over said distance.

3. A shaving apparatus as claimed in claim 1, wherein the housing is provided with an upright wall portion the height of which is greater than the distance over which the shaving head holder can be depressed.

4. A shaving apparatus comprising:

a housing:

a shaving head holder including at least one cutting unit;

a pivot pin for pivotably connecting the shaving head holder to the housing such that the shaving head holder is pivotably movable in a first direction between an open position with respect to the housing and in a second direction to a closed position with respect to the housing, the closed position being the normal operating position for shaving;

a latch, the latch having a latched position that prevents the shaving head holder from moving in the first direction towards the open position, wherein the shaving head holder has a depressible distance associated with the latch within which latched position the shaving head holder may pivot, the pivotably depressible distance being bounded by a non-depressed position and a fully-depressed position: and a first spring for applying a spring force to the shaving head holder so as to urge the shaving head holder to pivot on the pivot pm toward the open position such that in the latched position, the shaving head holder is depressible against the spring force along the depressible distance.

5. A shaving apparatus as claimed in claim 1, wherein the latch comprises a latching cam situated in the housing, wherein the latching cam can be displaced against the action of a second spring from the latched position to an unlatched position of the shaving head holder and, in the closed position of the shaving head holder, said latching cam hooks behind a wall portion of the shaving head holder to latch the shaving head holder on the housing, a edge portion of the shaving head holder being situated at a distance from an opposite edge portion of the housing, said shaving head holder being pivotably depressible over said distance between edge portions.

6. A shaving apparatus as claimed in claim 1, wherein the housing is provided with a upright wall portion a height of which is selected such that the upright wall portion precludes that, in the closed position, cut-off hair parts can escape to the exterior the shaving apparatus via passage between the housing and the shaving head holder.

7. A shaving apparatus as claimed in claim 6, wherein the housing is provided with an upright wall portion the-a height of which is greater than the depressible distance over which the shaving head holder is pivotably depressible.

8. A shaving apparatus as claimed in claim 1, wherein, in the latched position and absent any external force counter to the spring force of the first spring, the first spring urges the shaving head holder so as to position the shaving head holder in the non depressed position.

9. A shaving apparatus as claimed in claim 1, wherein, in the latched position, the first spring urges the shaving head holder so that the shaving head holder is depressible against the spring force from the non-depressed position to the fully-depressed position.

10. A shaving apparatus as claimed in claim 1, wherein the latch has a latched position through which the shaving head holder is in the closed position.

* * * * *